US006164940A

United States Patent [19]

Terauchi et al.

[11] Patent Number: 6,164,940

[45] Date of Patent: Dec. 26, 2000

[54] SCROLL TYPE COMPRESSOR IN WHICH A SOFT STARTING MECHANISM IS IMPROVED WITH A SIMPLE STRUCTURE

[75] Inventors: Kiyoshi Terauchi, Isesaki; Akiyoshi Higashiyama, Gunma; Akihiro Kawano, Maebashi, all of Japan

[73] Assignee: Sanden Corporation, Gunma, Japan

[21] Appl. No.: 09/392,609

[22] Filed: Sep. 9, 1999

[30] Foreign Application Priority Data

Sep. 11, 1998 [JP] Japan ..... 10-258838

[51] Int. Cl.[7] ..... F01C 1/02

[52] U.S. Cl. ..... 418/55.1; 418/14

[58] Field of Search ..... 418/14, 55.1

[56] References Cited

U.S. PATENT DOCUMENTS

| | | | |
|---|---|---|---|
| 4,505,651 | 3/1985 | Terauchi et al. | 418/55.1 |
| 4,940,395 | 7/1990 | Yamamoto et al. | 418/55.1 |
| 5,336,058 | 8/1994 | Yokoyama | 418/55.1 |
| 5,855,475 | 1/1999 | Fujio et al. | 418/55.1 |
| 5,993,171 | 11/1999 | Higashiyama | 417/310 |

FOREIGN PATENT DOCUMENTS

| | | | |
|---|---|---|---|
| 60140 | 9/1982 | European Pat. Off. | 418/55.1 |
| 144169 | 6/1985 | European Pat. Off. | 418/55.1 |
| 211672 | 2/1987 | European Pat. Off. | 418/55.1 |
| 58-067903 | 4/1983 | Japan . | |
| 59-105994 | 6/1984 | Japan . | |
| 59-108896 | 6/1984 | Japan | 418/55.1 |
| 59-192880 | 11/1984 | Japan | 418/55.1 |
| 60-101296 | 6/1985 | Japan | 418/55.1 |
| 62-291491 | 12/1987 | Japan . | |
| 2-271094 | 11/1990 | Japan | 418/55.1 |
| 3-225093 | 10/1991 | Japan | 418/55.1 |
| 3-294687 | 12/1991 | Japan | 418/55.1 |
| 4-187886 | 7/1992 | Japan | 418/55.1 |
| 7-324690 | 12/1995 | Japan . | |

*Primary Examiner*—Thomas Denion
*Assistant Examiner*—Theresa Trieu
*Attorney, Agent, or Firm*—Baker Botts L.L.P.

[57] ABSTRACT

In a scroll type compressor in which a compression mechanism compresses a gaseous fluid with moving the gaseous fluid along a spiral path to produce a compressed gas, an escaping path is provided for escaping the compressed gas from the compression mechanism at an intermediate portion of the spiral path. A pressure transmission path transmits pressure of the compressed gas to a valve mechanism which is for controlling an open and an close of the escaping path. The pressure transmission path has a delay mechanism for delaying transmission of a change of the pressure to the valve mechanism.

12 Claims, 4 Drawing Sheets

SCROLL TYPE COMPRESSOR IN WHICH A SOFT STARTING MECHANISM IS IMPROVED WITH A SIMPLE STRUCTURE

BACKGROUND OF THE INVENTION

The present invention relates to a scroll type compressor which is included in, for example, an air conditioner for an automobile or vehicle.

An example of such a scroll type compressor is disclosed in Japanese Patent Publication (Unexamined) No. 7-324690 and comprises a compression mechanism for compressing a gaseous fluid with moving the gaseous fluid along a spiral path to produce a compressed gas. The compression mechanism is driven by an engine mounted on an automobile. Generally, an electromagnetic clutch device is provided between the engine and the compression mechanism. The electromagnetic clutch device serves to connect or disconnect the compression mechanism with or from the engine.

It is assumed as a frequent case that the electromagnetic clutch device is changed to an ON state during a traveling of the automobile. In the frequent case, a starting torque of the compressor becomes large to produce a shook which gives discomfort and an ill feeling to drivers and riders of the vehicle. In order to avoid such a shock, an attempt has been made to use a compressor which has a soft starter mechanism which permits a soft starting of the compressor and reduces the starting torque.

With reference to FIG. 5, description will be made as regards a conventional scroll type compressor which employs an example of the soft starter mechanism. The scroll type compressor illustrated in FIG. 5 has a front housing 101, bearings 111, 112 which are supported by the front housing 101 and a rotary shaft 105 rotatably supported by the bearings 111, 112. The rotary shaft 105 has at its one end a crank portion 106 in an eccentric or offset posture for a predetermined distance relative to a center of the rotary shaft 105. A movable scroll member 103 is rotatably supported by the crank portion 106 though a bearing 110 which receives a rotation of the rotary shaft 105 for an orbital movement.

The movable scroll member 103 has an end plate 103*a* having a round shaped groove 109 and the front housing 101 has an end plate 101*a* having a round shape 108. Between the two round grooves 108 and 109, a plurality of spherical members or balls 114 are secured to prevent a rotational movement of the movable scroll member 103.

The rotary shaft 105 has a balance weight 107 fixed thereto so as to correct a dynamic unbalance due to an eccentric structure of the movable scroll member 103 and the crank portion 106. Between the front housing 1-1 and the rotary shaft 105 is disposed a shaft seal 113 which prevents a refrigerant and lubricant in the compressor from leaking out of the device. A rear housing 102 is fixed to the front housing 101 by bolts 130 and has a suction port 121 and a discharge port 123, and the ports 121 and 123 are confined or separated by the end plate 104*a* of the fixed scroll member 104. In the example of FIG. 5 structure, an outermost circumferential space which is located at a left side of the end plate 104 of the fixed scroll member 104 is formed as a suction chamber whereas a space of the right side is formed as a discharge chamber 124.

The end plate 104*a* of the fixed scroll member 104 has a tubular space 125 in which a spool valve 127 to actuate by-pass holes 126 which are formed on the end plate 104*a* for by-passing the refrigerant in the compression chamber 150 into the suction chamber 122 through the tubular space 125. In the tubular space 125, a spring 128 is disposed in such a manner that it is contacted with the spool valve 127 and urges the spool valve 127 to open in the direction of the by-pass holes 126. Further, the tubular space 125 is connected with a pressure-direction hole 120 and the discharge hole 119, and a discharge pressure is directed to a side which contacts the spring 128 of the spool valve 127 and the other side thereof. In the illustration, reference numeral 129 represents a clip or a snap ring serving as a stopper for the spring 128.

Similarly, on the opposite side of the discharge hole, there are provided a tubular space 132, by-pass holes 131, and a pressure direction hole 136. In the tubular space 132, spool valve 133, a spring 134 and a stopper 135 are provided such that the spool valve 135 serves to actuate the by-pass holes 131.

In a case that the compressor is shut down or stopped, the refrigerant is not compressed and therefore a pressure in the discharge hole 119 in this state is a suction pressure Ps. Accordingly, no force or pressure is added to the spool valve 127, and a spring-bias is solely affected on the spool valve 127 by the spring 128, so that the spool valve 127 will be moved until it contacts a shoulder of the round hole (tubular space) 125. At this moment, the refrigerant in the compression chamber 150 travels through the by-pass holes 126 and then the tubular space 125 and further into the by-pass holes 126 and returns to the suction chamber 122. The refrigerant in the compression chamber 150 passes through, in turn, the by-pass holes 126, a groove portion formed on the outer circumference of the spool valve 127, the tubular space 125 connected the hole portion formed axially on the spool valve 127 and the by-pass holes 126 and then returns to the suction chamber 122. The same actuation and operation are provided with respect to the by-pass holes 131.

In view of the above, an actual suction volume is small when the compressor is driven in the state described above and, therefore, a load fluctuation is relatively small and a shock to the vehicle is small. When an operation of the compressor is started to begin compression of the refrigerant, a pressure in the discharge hole 119 is elevated upward. A pressure difference between the discharge pressure and the suction pressure Ps is effected to the spool valve 127 through the pressure-direction hole 120. The spool valve 127 is moved until it contact against the stopper 129. At this moment, the by-pass holes 126 are closed by the spool valve 127 and similarly the by-pass holes 131 are closed.

Therefore, the compressor provides 100% suction volume without a by-passing operation. Thus, the conventional compressor serves to make it small a load fluctuation at the time of start of the compressor to lessen a shock to the vehicle.

In the conventional compressor which incorporates therein the soft starter mechanism as described, a starting torque can be reduced by the used of the soft starter mechanism. However, the soft starter mechanism has a problem that an operational reaction range relative to the number of rotation and temperature conditions is small with respect to the starting conditions of the compressor.

In the compressor with the soft starter mechanism described above, if a compression pressure is set higher, there is a problem that a substantial time for a necessary pressure elevation in the discharge hole 119 is required under the conditions of a low rotational speed and a low atmospheric temperature. Therefore, a sufficient volume is not obtained. On the contrary, if the compression pressure is set to be lower, a pressure elevation of the discharge hole 119 is made rapidly under the condition of a high rotational speed and a high atmospheric temperature. Therefore, a volume to be captured becomes full, with the result that a soft starting effect is not expected.

In other words, at the time of low load of a discharge pressure at the start of the operation, if a biasing force of the spring 128 to the spool valve 127 is set to be lower so that a maximum volume is set up at a low speed operation, the spool valve 127 immediately closes the by-pass hole 126 at a start of the compressor, at the time of high load and high speed where at the discharge pressure is high. Therefore, a torque shock is not reduced and no effect of a soft starter is expected.

By contrast, if a biasing force of the spring 128 is set higher so as to obtain the required effects at the time of high load and high speed, a setting up into the maximum volume is not realized at the time of a lower load.

SUMMARY OF THE INVENTION

It is therefore an object of the present invention to provide an improved scroll type compressor which can provide less torque shock at the time of a high load and high speed and also permits a setting up to maximum volume at the time of low load and low speed.

It is another object of the present invention to provide a scroll type compressor which has a simple structure and permits a soft starting operation.

It is further object of the present invention to provide a scroll type compressor which has a torque shock reduction mechanism (a soft starter mechanism) to permit, at the time of an ON state of an electromagnetic clutch device, a wide and reliable operational reaction range relative to a rotational speed and atmospheric temperature conditions.

Other objects of the present invention will become clear as the description proceeds. According to an aspect of the present invention, there is provided a scroll type compressor which comprises a compression mechanism for compressing a gaseous fluid with moving the gaseous fluid along a spiral path to produce a compressed gas, an escaping path connected to the compression mechanism for escaping the compressed gas from the compression mechanism at an intermediate portion of the spiral path, a valve mechanism connected to the escaping path for controlling an open and an close of the escaping path, and a pressure transmission path connected to the compression mechanism and the valve mechanism for transmitting pressure of the compressed gas to the valve mechanism, the pressure transmission path comprising a delay mechanism for delaying transmission of a change of the pressure to the valve mechanism.

According to another aspect of the present invention, there is provided a scroll type compressor which comprises a housing having a suction chamber and a discharge chamber, a fixed scroll member having, in the housing, a first end plate and a fixed involute wrap fitted on the first end plate, a movable scroll member having, in the housing, and a second end plate and a movable involute wrap fitted on the second end plate. In the scroll type compressor, the movable scroll member is driven in an orbital movement to vary a volume of a compression chamber confined between the movable involute wrap and the fixed involute wrap and move the compression chamber toward a central portion thereof, to thereby compress a fluid directed from the suction chamber to the compression chamber and discharge the compressed fluid into the discharge chamber, the first end plate having a by-pass hole for by-passing the fluid in the compression chamber along the fixed involute wrap and a valve mechanism on the by-pass hole for actuating the by-pass hole, the valve mechanism having a cylinder chamber on the first end plate and a piston valve reciprocally disposed in the cylinder chamber, one end of the cylinder chamber being connected to the suction chamber. The scroll type compressor further comprises a spring means for urging the by-pass hole in an opening direction, the spring being connected to the piston valve at its one end and to a stopper at its other end, and delay means, between a passage for intaking a high pressure gas and a back pressure side of the piston valve, for delaying a transmission of a pressure change to the back pressure side of the piston valve in the cylinder chamber.

DESCRIPTION OF THE PREFERRED EMBODIMENT

Figure 1:
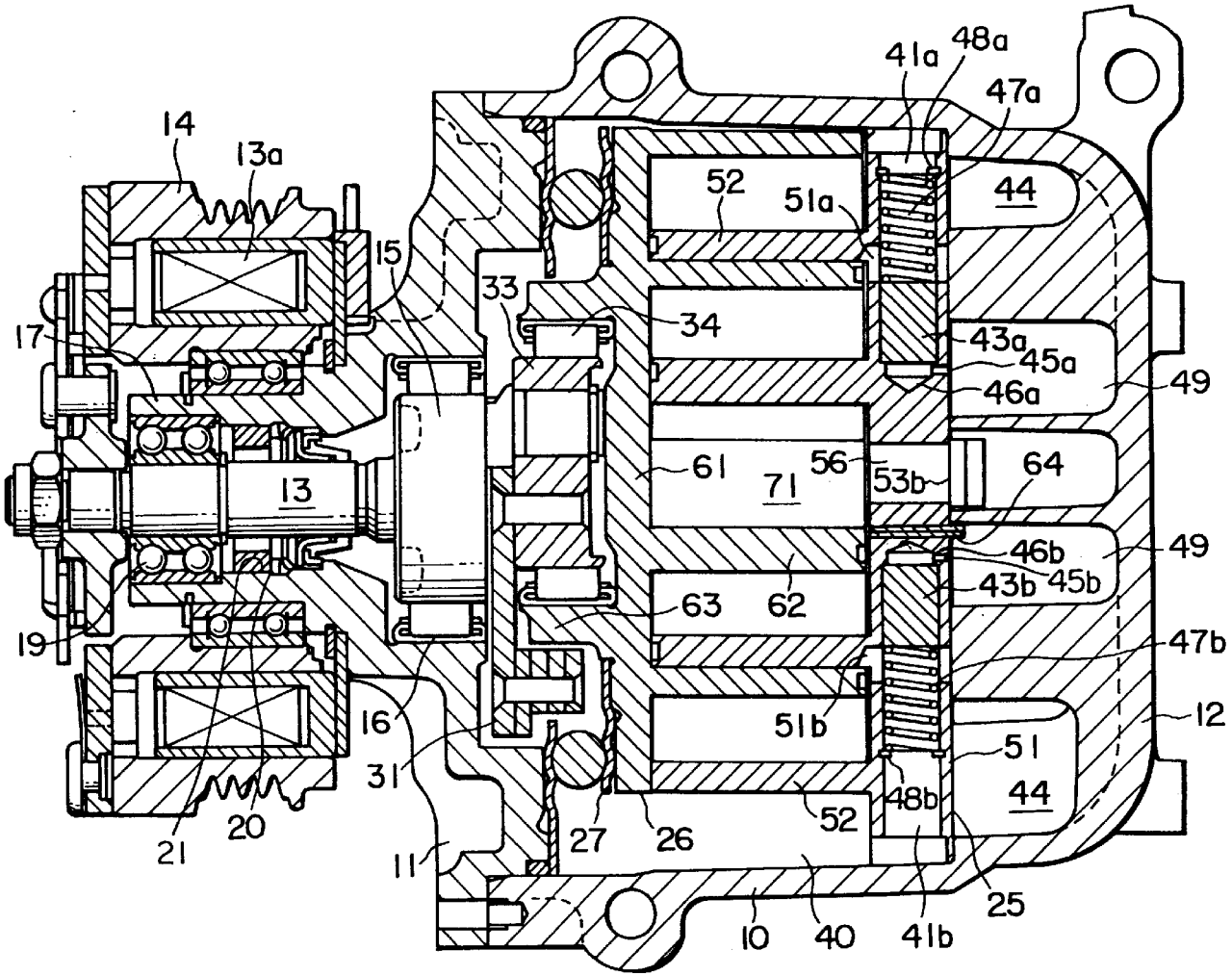
FIG. 1 is a sectional view of a scroll type compressor according to an embodiment of the invention.

With reference to FIGS. 1 though 4, the description will be made as regards a scroll type compressor according to an embodiment of the invention.

The scroll type compressor is for compressing a refrigerant gas into a compressed gas and has a housing 10 which has a front end plate (front housing) 11 and a cup-shaped portion (that is, a rear casing) 12 fitted to the front end plate 11. The front end plate 11 has a through hole 21 at a center thereof for inserting a main shaft 13 therethrough. The main shaft 13 has a large diameter portion 15 on the inner end portion. The large diameter portion 15 is rotatably supported by the needle bearing 16. The large diameter portion 15 has a ring-like eccentric bush 33 in an eccentric posture relative to the main shaft 13.

The front end plate 11 has a sleeve 17 which extends forward to surround the main shaft 13 and a ball bearing 19 is provided at a front end portion of the sleeve 17 so that the main shaft 13 is rotatably supported by the ball bearing 19.

On the main shaft 13, a shaft seal assembly 20 is provided in the through hole 21, and a rotational force of an external driving source (such as automobile engine) is transmitted to the main shaft 13 through an electromagnetic clutch mechanism 14. The electromagnetic clutch mechanism 14 transmits a rotational movement from the external driving source to a pulley device through a V-belt (not shown) and serves to control a rotational movement from the pulley device to the main shaft 13 by the control of electric supply to a magnetic exciting coil 13*a*.

The cup-shaped portion 12 has a discharge chamber 44 and a buffer chamber 49 inside the discharge chamber 44. In the cup-shaped portion 12, a fixed scroll member 25 and a movable scroll member 26 are provided as well as a rotation prevention mechanism 27. The fixed scroll member 25 has a first or fixed end plate 51 and a first or fixed involute wrap 52 fixed to a surface of the first end plate 51 and defining a spiral path. The first end plate 51 is fixed to the cup shaped portion 12. The movable scroll member 26 has a second or movable end plate 61 and a second or movable involute wrap 62 fixed to a surface of the second end plate 61. The second end plate 61 has an annular boss 63 formed on the opposite side of the second involute wrap 62. The boss 63 is engaged with a bush 33 and rotatable supported through a needle bearing 34. Further, a semi-circular balance weight 31 extending radially is provided to the bush in a unitary structure with the bush 33.

The second involute wrap 62 is engaged with the first involute wrap 52 in a 180° offset relation with each other to form a compression chamber 71 which is called as a fluid pocket between the first involute wrap 52 and the second involute wrap 62. The movable scroll member 26 is connected with the rotation prevention mechanism 27 so that it is prevented from being rotated by means of the rotation prevention mechanism 27 but it is permitted to be driven into an orbital movement along a predetermined orbit according to a rotation of the main shaft. So that, the compression chamber 71 is moved toward a central portion and, at the same time, the refrigerant gas forced into the compression chamber from the suction chamber 40 is subjected to compression and discharged, as the compressed refrigerant, into the discharge chamber 44 out of the discharge port 56 which is provided at the central portion of the first end plate 51. A combination of the main shaft 13, the bush 33, the needle bearing 34, and the rotation preventing mechanism 27 will be referred to as a driving mechanism which driving the movable scroll member 26 to move the compression chamber 71 along the spiral path with gradual reduction of a volume thereof. A combination of the driving mechanism and the fixed and the movable scroll members 25 and 26 is referred to as a compression mechanism which is for compressing a gaseous fluid with moving the gaseous fluid along the spiral path to produce a compressed gas.

The first end plate 51 of the fixed scroll member 25 has two by-pass holes 51*a* and 51*b* and two cylinder chambers 41*a* and 41*b*. The by-pass holes 51*a* and 51*b* are communicated with intermediate portions of the spiral path, respectively. Each of the cylinder chambers 41*a* and 41*b* is extended in a radial direction. Two piston valves 43*a* and 43*b* are slidably inserted as valve mechanisms in the cylinder chambers 41*a* and 41*b*, respectively. Each of the cylinder chambers 41*a* and 41*b* has an open end which is communicated with an outer portion of the spiral path through the suction chamber 40. A combination of the by-pass holes 51*a* and 51*b* and the cylinder chambers 41*a* and 41*b* is referred to as an escaping path.

The piston valves 43*a* and 43*b* are contacted with ends of two compression springs 47*a* and 47*b* which are engaged at these other ends with stoppers 48*a* and 48*b*. That is, the piston valves 43*a* and 43*b* are supported by the springs 47*a* and 47*b* and spring-biased in an upper an a lower direction, respectively.

Further, the first end plate 51 of the fixed scroll member 25 has two back pressure chambers 46*a* and 46*b*, two discharge gas directing holes 45*a* and 45*b*, and an orifice 64. The back pressure chambers 46*a* and 46*b* confront against end surfaces of the piston valves 43*a* and 43*b*. The discharge gas directing holes 45*a* and 45*b* connect the back pressure chambers 46*a* and 46*b* with the buffer chamber 49. The orifice 64 extends from the compression chamber 71 to the buffer chamber 49. In other words, the orifice 64 is connected to an inner portion of the spiral path. The orifice 64 will be referred to as a high pressure path. A combination of the high pressure path, the buffer chamber 49, and the discharge gas directing holes 45*a* and 45*b*, and the back pressure chambers 46*a* and 46*b* will be referred to as a pressure transmission path.

As described above, the buffer chamber 49 is connected with the back pressure chambers 46*a* and 46*b* through the discharge gas directing holes 45*a* and 45*b*. Consequently, it will be considered that a pressure of the buffer chamber 49 is added to the end of each of the piston valves 43*a* and 43*b*. The piston valves 43*a* and 43*b* are moved in accordance with a difference between a biasing force of the spring 47*a* and 47*b* and the pressure in the buffer chamber 49. Therefore, the movement of each of the piston valves 43*a* and 43*b* activates each of the by-pass holes 51*a* and 51*b*. In other words, if a pressure in the buffer chamber 49 is controlled, an activation of the piston valves 43*a* and 43*b* is controlled so that the by-pass holes 51*a* and 51*b* are activated into an open/close posture. Thus, the activation of the by-pass holes 51*a* and 51*b* permit to vary a volume of the compressor.

Figure 2:
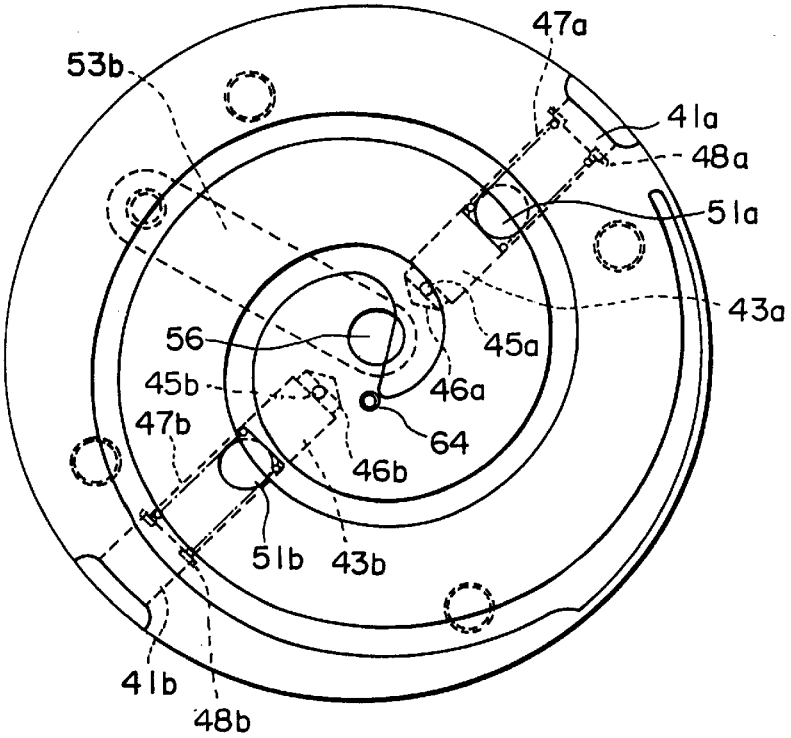
FIG. 2 is a plan view of a fixed scroll member of the scroll type compressor shown in FIG. 1, seen from a first end plate.
Figure 3:
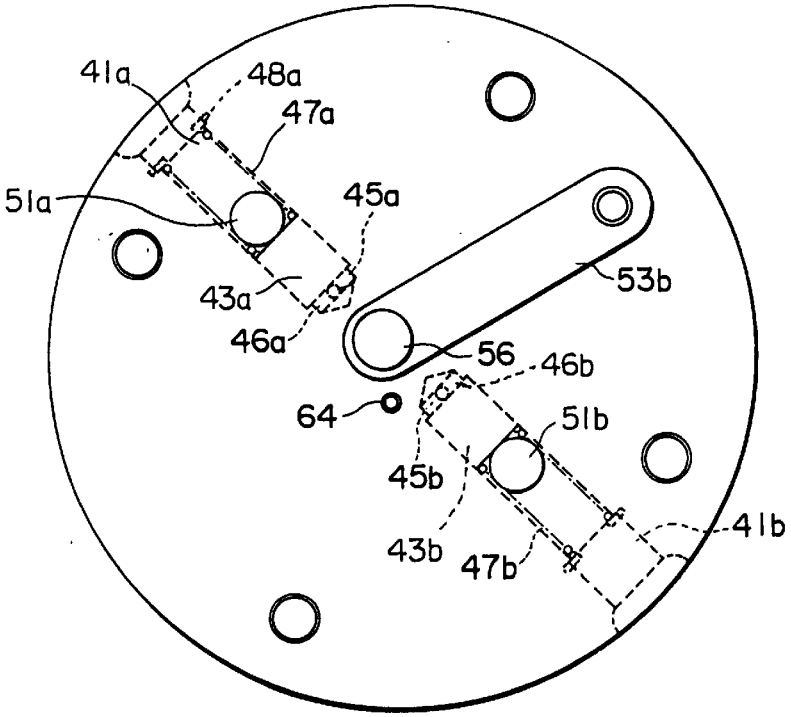
FIG. 3 is a plan view of the fixed scroll member of the scroll type compressor shown in FIG. 1, seen from a back side of first end plate.
Figure 4:
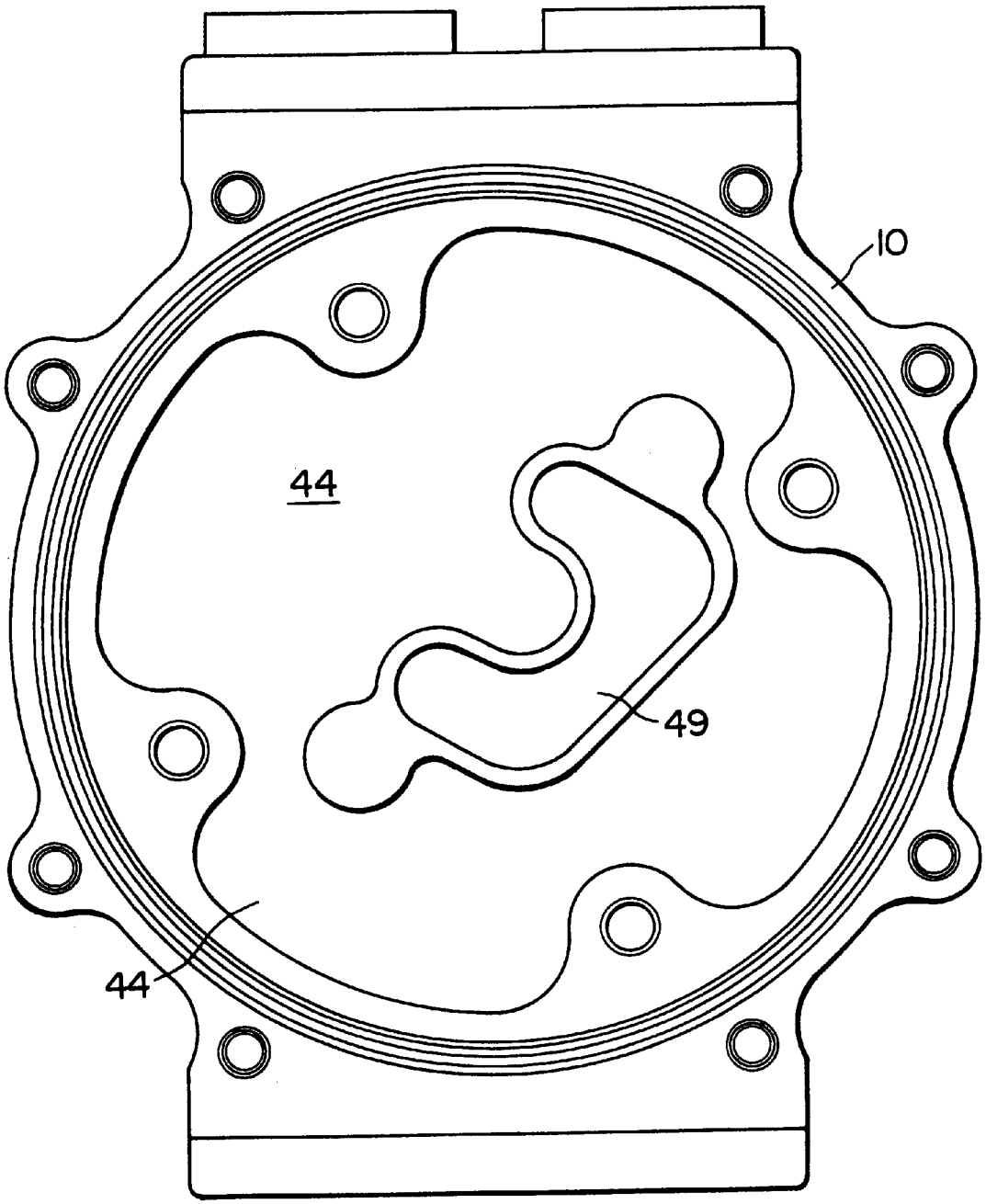
FIG. 4 is a plan view of a housing of the scroll type compressor shown in FIG. 1, seen from an opening portion.
Figure 5:
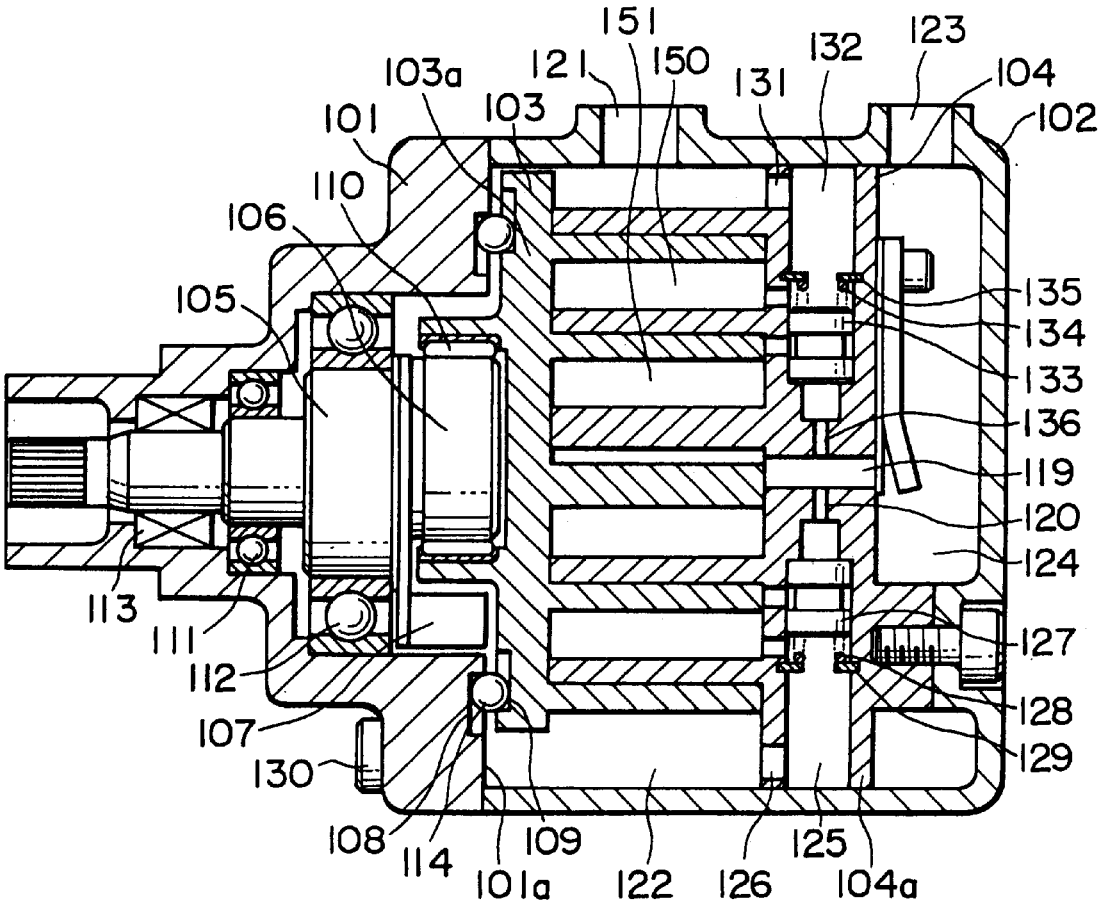
FIG. 5 PRIOR ART
FIG. 5 is a sectional view of a conventional scroll type compressor.

As illustrated in FIGS. 2 and 3, the first end plate 51 has a discharge valve 53*b* for opening/closing the discharge hole 56. The cylinder chambers 41*a* and 41*b* are provided in a closely related position relative to the suction chamber 40. As described above, the pressure in the buffer chamber 49 is regulated to control the piston valve mechanism so that activation of the by-pass holes 51*a* and 51*b* is controlled.

With reference to FIGS. 1 through 4, an operation of the scroll compressor will be described. The state shown in FIG. 1 is an OFF state of the electromagnetic clutch device 14, the compressor being stopped. In this state, the piston valves 43*a* and 43*b* are spring biased by the springs 47*a* and 47*b* toward the back pressure chambers 46*a* and 46*b*. At this moment, the by-pass holes 51*a* and 51*b* are opened. In this state, a refrigerant gas of the suction chamber 40 which is incorporated or captured in the compression chamber 71 is not compressed until it reaches the by-pass holes 51*a* and 51*b*, but is returned to the suction chamber 40 through the by-pass holes 51*a* and 51*b* and the cylinder chambers 41*a* and 41*b*, and a refrigerant gas which was compressed in the compression chamber after the by-pass holes 51*a* and 51*b* will be compressed.

Accordingly, an actual discharge volume is reduced at an initial time of operation and, therefore, a compressive load is small, with the result of a low level of torque shock.

Immediately after the starting of the compressor, a pressure in the buffer chamber 49 is low. Therefore, the piston valves 43*a* is spring-biased against, and force deep into, an upper and a lower portion of the cylinder chambers 41*a* and 41*b* by the springs 47*a* and 47*b*. At this moment, the by-pass holes 51*a* and 51*b* are opened.

After the electromagnetic clutch is placed into an ON state, the refrigerant gas incorporated into the compression chamber 71 is directed into the back pressure chambers 46*a* and 46*b* through the orifice 64, the buffer chamber 49, and the discharge gas directing holes 45*a* and 45*b*. When a back pressure force becomes larger than a spring force of the springs 47*a* and 47*b*, the piston valves 43*a* and 43*b* are activated to compress the springs 47*a* and 47*b* to thereby close the by-pass holes 51*a* and 51*b*. This permits a booting or setting-up into a maximum volume.

The refrigerant gas in the compression chamber 71 is decreased in its flowing volume by the orifice 64, and is decreased in its pressure and flown into the buffer chamber 49 where the pressure of the refrigerant gas is further decreased. Therefore, an elevation of the gas pressure becomes rather gentle at the back pressure chambers 46*a* and 46*b* which are connected to the buffer chamber 49 through the gas directing holes 45*a* and 45*b*. In this event, the buffer chamber 49 causes a delay in transmission of a change of the gas pressure to the piston valves 43*a* and 43*b* and is referred to as a delay mechanism.

Therefore, even if a spring force of the springs 47*a* and 47*b* is set at a low level such that setting up or booting into a maximum volume at a case of a low load where the discharge pressure is low, a gas pressure in the back pressure chambers 46*a* and 46*b* of the piston valves 43*a* and 43*b* after the start of the operation is raised so that the time until the piston valves 43*a* and 43*b* close the by-pass holes 51*a* and 51*b* can be elongated. Accordingly, a torque shock at the time of a high load and high speed can be reduced.

According to the scroll type compressor, a torque shock can be minimized at the time of a high load/high speed operation. Even in the case of a low load/low speed operation, set-up (that is, booting) to a maximum volume can be obtained. Consequently, a soft start can be achieved with a simple structure.

In addition to the above, when a spring force of the spring is set so that a set-up for a maximum volume can be obtained at the time of a low load/low speed, a soft start can be realized at the time of a high load/high speed operation. Therefore, an operational reaction range as a rotational speed and environmental/atmospheric conditions can be made wider and more reliable.

Further, if the buffer chamber is made with the first end plate and the cup shaped portion as described above, it will be easy to realize a structure that a space of the buffer chamber is formed integral with the cup shaped portion. Besides, sealing relative to the first end plate can be established by a surface sealing structure which, therefore, directs to cost reduction of the entire apparatus.

Moreover, the structure that the buffer chamber is located inside the discharge chamber will make it easy to provide in a desired location the soft starter mechanism.

While the present invention has thus far been described in connection with a single embodiment thereof, it will readily be possible for those skilled in the art to put this invention into practice in various other manners. For example, the scroll type compressor may comprise a single escaping path or three or more escaping paths.

What is claimed is:

1. A scroll type compressor comprising:

a compression mechanism for compressing a gaseous fluid with moving said gaseous fluid along a spiral path to produce a compressed gas;

an escaping path connected to said compression mechanism for escaping said compressed gas from said compression mechanism at an intermediate portion of said spiral path;

a valve mechanism connected to said escaping path for controlling an open and an close of said escaping path; and a pressure transmission path connected to said compression mechanism and said valve mechanism for transmitting pressure of said compressed gas to said valve mechanism, said pressure transmission path comprising a delay mechanism for delaying transmission of a change of said pressure to said valve mechanism.

2. A scroll type compressor as claimed in claim 1, wherein said compression mechanism comprises:

a fixed scroll member defining said spiral path;

a movable scroll member cooperated with said fixed scroll member to define a compression chamber therebetween which is for taking said gaseous fluid therein; and a driving mechanism connected to said movable scroll member for driving said movable scroll member to move said compression chamber along said spiral path with gradual reduction of a volume thereof.

3. A scroll type compressor as claimed in claim 2, wherein said fixed scroll member comprises:

a fixed involute wrap extending along said spiral path to have a space; and a fixed end plate fixed to an axial end of said fixed involute wrap;

said movable scroll member comprising:

a movable involute wrap inserted in said space of the fixed involute wrap; and a movable end plate fixed to an axial end of said movable involute wrap.

4. A scroll type compressor as claimed in claim 3, wherein said escaping path comprising:

a cylinder chamber formed in said fixed end plate to communicate with an outer portion of said spiral path; and a by-pass hole formed in said fixed end plate to communicate said cylinder chamber with said intermediate portion of the spiral path;

said valve mechanism comprising a piston valve which is inserted in said cylinder chamber and slidable to open and close said by-pass hole, said intermediate portion being communicated with said outer portion through said by-pass hole and said cylinder chamber when said piston valve opens said by-pass hole.

5. A scroll type compressor as claimed in claim 4, wherein said pressure transmission path comprises:

a back pressure chamber formed in said fixed end plate for providing a back pressure to said piston valve to close said by-pass hole;

a high pressure path penetrating said fixed end plate and connected to an inner portion of said spiral path;

a buffer chamber connected to said high pressure path and operable as said delay mechanism; and a discharge gas direction hole connected between said buffer chamber and said back pressure chamber.

6. A scroll type compressor as claimed in claim 5, further comprising a spring urging said piston valve against said back pressure to open said by-pass hole.

7. A scroll type compressor as claimed in claim 6, further comprising a stopper placed in said cylinder chamber, said spring being engaged between said stopper and said piston valve to urge said piston valve towards said back pressure chamber.

8. A scroll type compressor as claimed in claim 5, wherein said high pressure path has an orifice between said inner portion of the spiral path and said buffer chamber.

9. A scroll type compressor as claimed in claim 3, further comprising a housing containing said compression mechanism therein, said fixed scroll member being fixed to said housing, said housing being cooperated with said fixed end plate to define said buffer chamber and a discharge chamber which is for discharging said compressed gas.

10. A scroll type compressor as claimed in claim 9, wherein said discharge chamber extends around said buffer chamber.

11. A scroll type compressor as claimed in claim 9, wherein said housing being cooperated with said fixed involute wrap to define a suction chamber which is adjacent to said outer portion of the spiral path and is for sucking said gaseous fluid.

12. A scroll type compressor comprising:

a housing having a suction chamber and a discharge chamber;

a fixed scroll member having, in said housing, a first end plate and a fixed involute wrap fitted on said first end plate;

a movable scroll member having, in said housing, a second end plate and a movable involute wrap fitted on said second end plate;

wherein said movable scroll member is driven in an orbital movement to vary a volume of a compression chamber confined between said movable involute wrap and said fixed involute wrap and move said compression chamber toward a central portion thereof, to thereby compress a fluid directed from said suction chamber to said compression chamber and discharge said compressed fluid into said discharge chamber;

said first end plate having a by-pass hole for by-passing the fluid in said compression chamber along said fixed involute wrap and a valve mechanism on said by-pass hole for actuating said by-pass hole;

said valve mechanism having a cylinder chamber on said first end plate and a piston valve reciprocally disposed in said cylinder chamber;

one end of said cylinder chamber being connected to said suction chamber;

a spring means for urging said by-pass hole in an opening direction, said spring being connected to said piston valve at its one end and to a stopper at its other end; and delay means, between a passage for intaking a high pressure gas and a back pressure side of said piston valve, for delaying a transmission of a pressure change to said back pressure side of said piston valve in said cylinder chamber.

* * * * *